US007204637B2

(12) United States Patent
Sherman et al.

(10) Patent No.: US 7,204,637 B2
(45) Date of Patent: Apr. 17, 2007

(54) AUTOMATED DEVICE FOR HOMOGENIZATION AND RESUSPENSION OF SUBSTANCES, DISINTEGRATION OF CELLS, DISRUPTION OF TISSUES AND CENTRIFUGATION OF THESE MEDIA

(76) Inventors: Michael Sherman, 581 Saw Mill Brook Pkwy., Newton, MA (US) 02459; Yury Sherman, 511 Beech St., Roslindale, MA (US) 02131

( * ) Notice: Subject to any disclaimer, the term of this patent is extended or adjusted under 35 U.S.C. 154(b) by 0 days.

(21) Appl. No.: 10/866,050

(22) Filed: Jun. 14, 2004

(65) Prior Publication Data

US 2005/0277538 A1 Dec. 15, 2005

(51) Int. Cl.
*B01F 11/00* (2006.01)
*B04B 5/02* (2006.01)

(52) U.S. Cl. ..... 366/214; 494/16; 494/47

(58) Field of Classification Search ..... 366/213–214; 494/47, 31, 33, 84, 16, 20
See application file for complete search history.

(56) References Cited

U.S. PATENT DOCUMENTS 2,507,309 A * 5/1950 Larsson ..... 494/16
3,061,280 A * 10/1962 Kraft et al. ..... 366/110
3,159,384 A * 12/1964 Davis ..... 366/110
3,420,437 A * 1/1969 Blum et al. ..... 494/20
3,722,789 A * 3/1973 Kennedy ..... 494/17
3,877,634 A * 4/1975 Rohde et al. ..... 494/1
4,329,068 A * 5/1982 Neuner et al. ..... 366/214
4,820,257 A * 4/1989 Ishimaru
4,990,130 A * 2/1991 Prais ..... 494/20
5,195,825 A * 3/1993 Ringrose ..... 366/213
5,199,937 A * 4/1993 Wada et al. ..... 494/7
5,567,050 A * 10/1996 Zlobinsky et al. ..... 366/209
5,769,538 A * 6/1998 Sherman et al. ..... 366/198
6,235,245 B1 * 5/2001 Sherman et al. ..... 422/102
6,837,843 B2 * 1/2005 Gazeau et al. ..... 494/10

* cited by examiner

*Primary Examiner*—Charles E. Cooley
(74) *Attorney, Agent, or Firm*—Archibald IP LLC; Patrick D. Archibald

(57) ABSTRACT

A device for mixing, homogenization, resuspension, disintegration, disruption, or centrifugation of media placed in test tubes, including: a rotor having a replaceable closure; a driver having a substantially vertical shaft; a sleeve having a spiral groove and a bush moveable along the sleeve, moving the rotor up and down; and a stationary ring with extended teeth faced toward the rotor. When the rotor is in its lower position the tubes engage the teeth and receive strikes which induce vigorous motion and effective mixing of media inside the tube. When the rotor is in its upper position the tubes are disengaged with the teeth and rotation of the rotor provides centrifugation of the media.

1 Claim, 2 Drawing Sheets

AUTOMATED DEVICE FOR HOMOGENIZATION AND RESUSPENSION OF SUBSTANCES, DISINTEGRATION OF CELLS, DISRUPTION OF TISSUES AND CENTRIFUGATION OF THESE MEDIA

TECHNICAL FIELD

The present invention relates to homogenization of substances and disruption/disintegration of cells and tissues, and centrifugation of these media and, more particularly, to a novel automated device for homogenization and resuspension of substances, disruption of living cells, disintegration of tissues contained in test tubes, and centrifugation of these and similar media.

BACKGROUND ART

Disruption of various types of cells and tissues, mixing solutions and centrifugation are very widespread procedures both in biomedical researches and clinics. Often these procedures are performed in multiple test tubes. The test tubes filled with various solutions, cell suspensions or pieces of tissues, are exposed to homogenization, or mixing, or resuspension, or disruption, or disintegration followed by centrifugation. Accordingly tubes having tested media inside should be taken from a rack, manually placed in a device that makes homogeneous solution of the media, and then manually placed in a centrifuge rotor. These procedures are time-consuming and tedious, and often lead to mistakes i placing of tubes in a proper order, eventually leading to mistakes in experimental results. An automated device which combines these functions to reduce manual operations and inevitable errors would be very desirable.

However, existing technologies of mixing/disintegration centrifugation are the main obstacle for creation of such a device.

The nature of the processes of homogenization/resuspension and disintegration/disruption of substances are quite opposite to the centrifugation process. The first two are used to make homogenized media, whereas the centrifugation needs to separate the homogenized media into liquid and solid components. This difference determines differences in mechanical principals of the existing devices: homogenization/resuspension is achieved by vibrating, shaking and vortexing of media in test tubes whereas centrifugation—by high-speed rotation of tubes along an outside axis. As a result, even though these processes are usually performed subsequently, they are incompatible.

The development of a device that can perform both processes became possible after a new striking technology for homogenization/resuspension of substances and disintegration/disruption of tissues and cells was invented (US patents "Mixer having means for periodically mechanically striking liquid-containing tubes to induce motion of the tubes" U.S. Pat. No. 5,769,538).

The technology is based on striking of test tubes with media placed inside. The tubes are subjected to thousands (5,000–8,000 or more) of hits per minute that induce vigorous turbulent motion of the media and a very effective homogenization/resuspension of substances and disintegration/disruption of cells and tissues in presence of glass beads. As a striking means it is used multiple of extensions engaged the tubes' walls when the striking means is rotated.

The described technology, as well as centrifugation technology, both based on rotation of the tubes or means for their processing about outside axis. These technologies are compatible, that is exploited in the present invention.

Accordingly, a principal object of the present invention is to provide an automated deice for mixing and homogenization substances or resuspension pellets or disintegration of living cells, or disruption of tissues placed in test tubes, and subsequent centrifugation these media. Additional advantage of the device is ability to remove the rotor from the device, and place it on a separate stand to be used as a rack for manipulations with the tubes.

DISCLOSURE OF INVENTION

The present invention achieves the above objectives, among others, by providing, in a preferred embodiment, a device for biological and medical tests wherein tested media placed in test tube is subjected to following processes performed in two stages: the first stage is mixing, or homogenization, or resuspension, or disintegration, or disruption, and the second stage is centrifugation, comprising: a housing, a replaceable rotor for said tubes having a closure, a driving means for rotation of said rotor about the axis located outside said tubes, capable to rotate said rotor clockwise or counterclockwise, a means for moving the rotor along the shaft, and a striking means, capable to engage walls of said tubes at the first stage and disengage the walls at the second stage of processing of tested tubes.

BRIEF DESCRIPTION OF DRAWINGS

Understanding of the present invention and various aspects thereof will be facilitated by reference to the accompanying drawing figures, provided for purposes of illustration only and not intended to define the scope of the invention, on which.

DETAILED DESCRIPTION OF THE PREFERRED EMBODIMENTS

Figure 1:
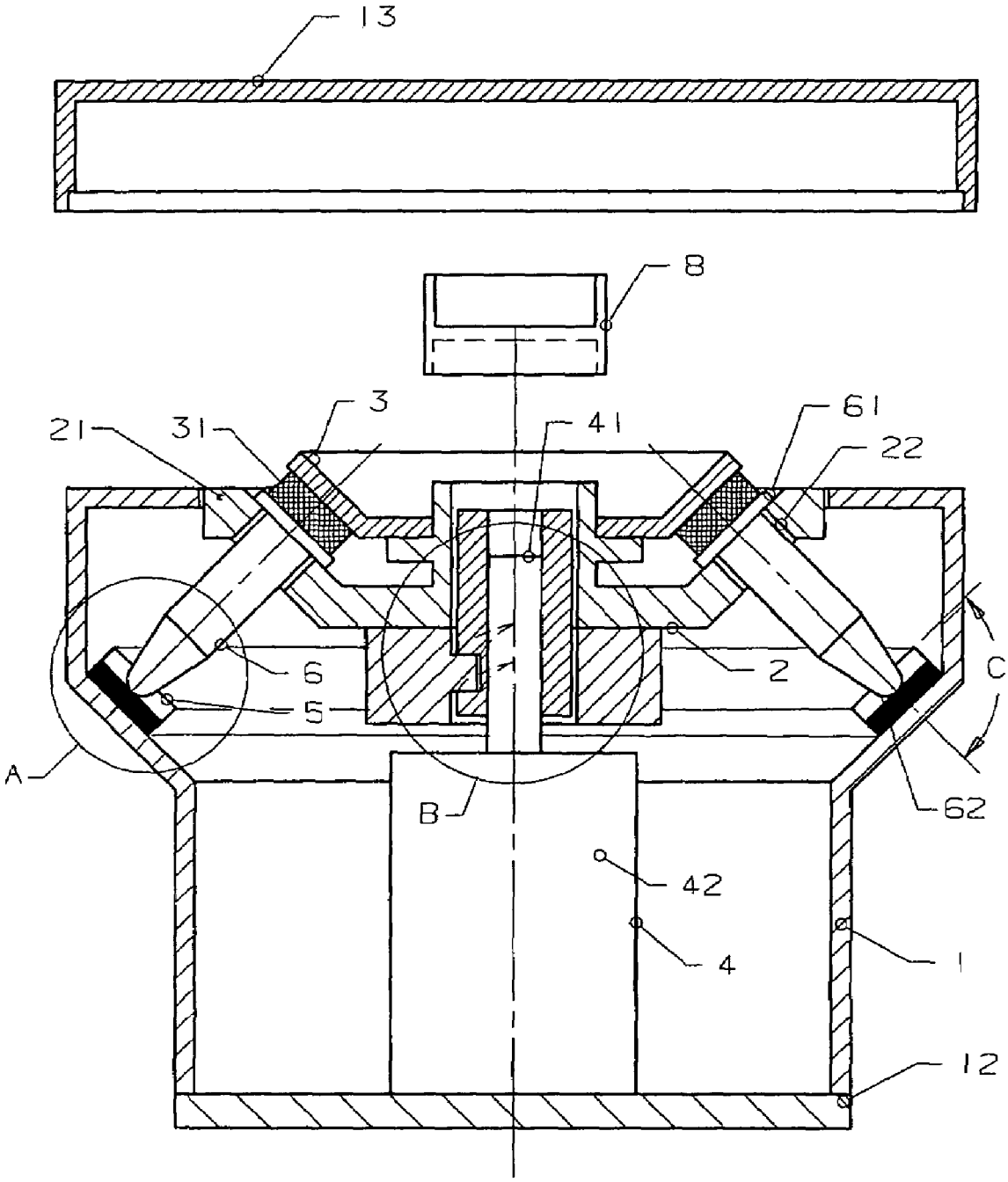
FIG. 1 is a cross sectional view of the device when test tubes are subjected to striking.

The invention is related to automated devices for biological and medical tests wherein tested media in test tube is subjected to mixing, or homogenization, or resuspension, or disintegration, or disruption, or centrifugation.

The main novelty in this device is striking of test tubes that induce vigorous motion of the media inside the tubes, and following centrifugation of the media in the tubes.

The description of the invention is made with an example of a device for test tubes of 1.5–2 ml volume, providing consequently homogenization of substances in test tubes and centrifugation of the homogenized media.

Referring to the drawings in detail, in FIGS. 1–4 a device for homogenization and centrifugation of substances placed in test tubes is shown in the preferred embodiment. The device includes: housing 1 having base 12 and lid 13, rotor 2 having replaceable closure 3, driving means 4 that is an electric motor having substantially vertical shaft 41, striking means 5 capable to engage or disengage test tubes 6 and means 7 for moving rotor 2 up and down along shaft 41.

Rotor 2 is a support for a number of tubes 6. The main part of the rotor is disk 21 having holes 22 the tubes pass through. The axis of the holes is tilted about shaft 41 that provides tilted position of tubes 6. The diameter of flange 61 of the tube is bigger than the diameter of hole 22. Accordingly, rotor 2 supports the tubes (FIG. 1). The gap between hole 22 and tube 6 placed inside the rotor provides angular movement of the tube during rotation of the rotor.

Figure 3:
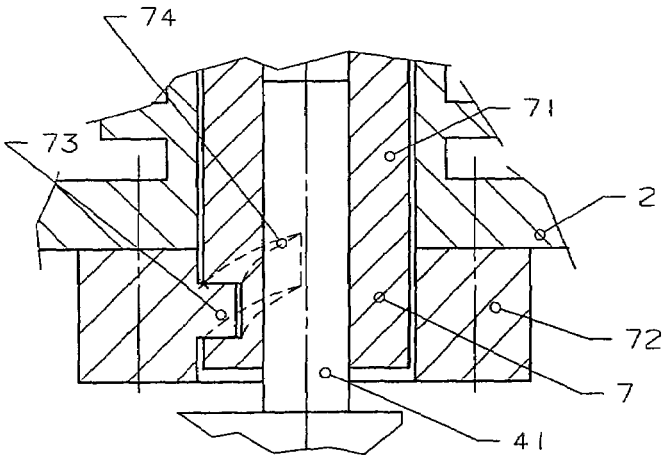
FIG. 3 is a fragment B in FIG. 1, showing means for moving the rotor up and down along the shaft.

Rotor 2 includes means 7 for moving the rotor up and down along shaft 41 (FIG. 3). Means 7 includes sleeve 71 and bush 72 embracing the sleeve. Sleeve 71 is attached to shaft 41, such that when the shaft is rotated, sleeve 71 receives the same rotation. the bush is moveable along sleeve 71. There is pin 73 extended from the bush, directed toward the sleeve. At the outer surface of the sleeve there is at least one spiral groove 74. The groove is capable to accommodate pin 73 and provides sliding contact with the pin, such that when the sleeve is rotated, the bush moves up or down along the sleeve. The distance (approx. ¼") between the upper and the lower ends of said groove determines extreme upper and extreme lower positions of bush 73 along sleeve 71 when the sleeve is rotated.

Rotor 2 is supported by and coupled with bush 72. when the bush is rotated about shaft 41, the rotor receives the same rotation and when the bush moves up or down along shaft 41, the rotor also moves up and down. As is clear, the same motions receive tubes 6 inside the rotor. The vertical motion of the tubes places them in a position providing engagement or disengagement of the tubes with striking means 5. As a version, rotor 2 can be integrated with bush 72.

Figure 2:
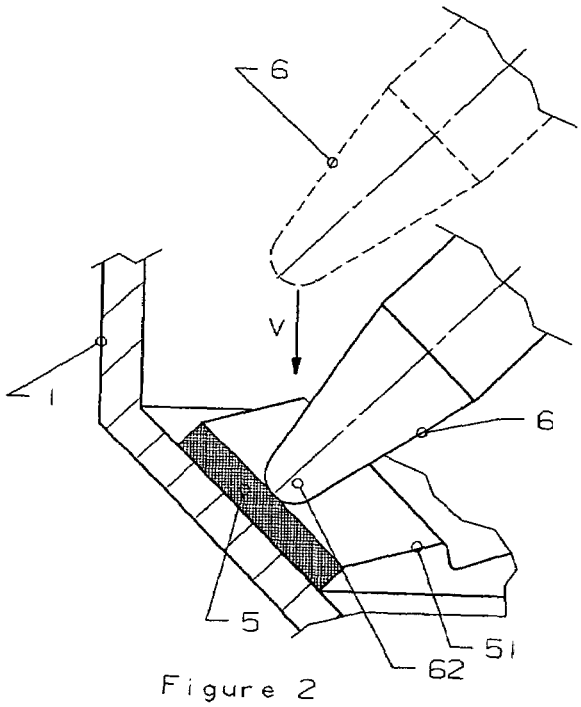
FIG. 2 is a fragment A in FIG. 1, showing test tubes placed in tube rotor in its lower position where the tubes' tips are engaged with striking means. Dotted line shows the test tubes placed in tube rotor in its upper position where tubes are disengaged with striking means.
Figure 4:
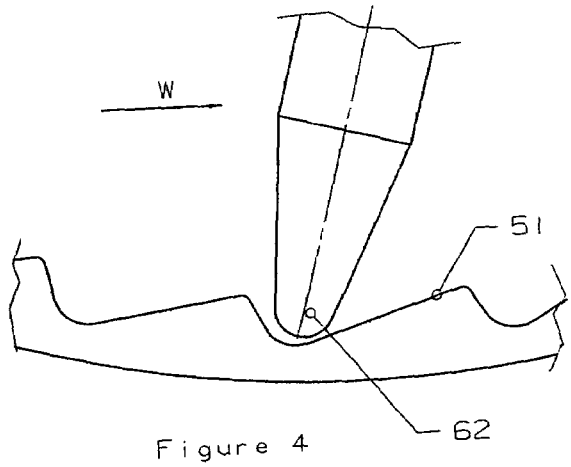
FIG. 4 is a side view along V in FIG. 2, showing sliding contact of test tubes with striking means, W is a direction of rotation of test tubes.

As is shown in FIGS. 1, 2 and 4, striking means 5 is a ring having a number of teeth 51 faced toward tubes 6. The ring is affixed to any stationary support, for example, to housing 1, as is shown in FIG. 1. Before start of processing of tubes 6, rotor 2 loaded with the tubes is set in its lower position, FIG. 2. There is a small gap between teeth 51 and tips **6*t*2 of the tubes. Then, rotation of the rotor generates centrifuge force applied to the tubes. This force moves tips 62 toward teeth 51, i.e. to a position where striking means 5 engages the tips, and presses the tips against the teeth. As a result, the tips receive sliding contact with teeth and periodical strikes, FIG. 4. At speed of rotation of the rotor, for example, 1500 rpm, which is usual for standard electric motors, each tip receives tens of thousands strikes per minute. These strikes induce vigorous motion of the media inside the tubes. As a result, mixing or resuspension of substances is performed almost instantly (in 5–7 sec.), and disintegration of cells, or disruption of tissues requires 2–3 min. To reduce noise caused by the strikes, striking means 5 is made of elastic material, for example, rubber, having high wearing resistance. As is shown in FIG. 1, striking means is inclined about axes of tubes 6. This inclination simplifies engagement and disengagement of the tubes with the striking means. Angle "C" (FIG. 1**) between the tube axis and the striking means is approximately 90 degrees.

To enhance effectiveness of mixing of substances, the rotor includes removable closure 3 overlapping flanges 61 of tubes 6 and pressing them against rotor 2 (FIG. 1). Closure 3 includes an elastic ring 31 faced toward the flanges, gently pressing them by the weight of the closure. The closure also prevents fly out of tubes 6 from rotor 2. Removable plug 8 fixes working position of closure 3 on rotor 2.

Electric motor 42 of driving means 5 provides clockwise and counterclockwise rotation of shaft 41. For the mixing process the shaft is rotated in one direction, which moves rotor 2 downward, in its lower position, where striking means 5 engages tubes 6. When the mixing is finished, rotation of the shaft changes its direction to opposite and rotor 2 is moved upward. In this position striking means 5 disengages tubes 6 (FIG. 2).

Depending on operator's needs, filling of rotor 2 with tubes 6 can be made when rotor 6 is attached to driving means 4 of the device, or removed from the device. In the last case the rotor should be placed on a special stand placed on a laboratory bench. The stand comprises: a base having a column and a plate affixed to the top end of the column. Sleeve 71 is set upon and embrace the column. In this position rotor can be used as a rack for filling the tubes or making other necessary manipulations with the tubes. To facilitate the manipulations and recording of the tubes, the rotor can be rotated around the stand.

This invention is not limited to the details shown since various modifications and structural changes are possible without departing in any way from the spirit of the present invention. What is desired to be protected is set forth in particular in the appended claims.

What is claimed is:

1. An automated device for processing media contained in test tubes, providing homogenization or resuspension of substances, or disruption of living cells, or disintegration of tissues, or centrifugation of these media by rotation of the tubes about an axis/axes located outside said tubes, processing said media in said tubes in two consequent stages: the first is homogenization or resuspension of substances, or disruption of living cells, or disintegration of tissues, and the second is centrifugation of the media, said device comprising:

(a) a rotor for said tubes having separated spaces accommodating one tube in one space, including a removable closure having an elastic ring that engages flanges of said tubes placed in said rotor, and presses said flanges against the rotor, and wherein each of said tubes is capable of changing its angular position under an applied outer force;

(b) a driving means for rotation of said rotor, having a substantially vertical shaft;

(c) a means for changing position of said rotor along said shaft, wherein said means for changing position of said rotor along the vertical axis of said shaft includes a sleeve having at least one spiral groove and a bush moveable about said sleeve, wherein said bush is attached to said rotor such that said rotor and said bush are moved as a single integrated part, and wherein said bush includes at least one pin accommodated by said at least one groove, moveable up and down inside the groove when said sleeve is rotated, fixing extreme upper and extreme lower positions of said bush and said rotor along said shaft;

(d) a striking means for engaging and periodically striking said tubes when said rotor is rotated and is in one of its extreme positions along said shaft and wherein said striking means disengages said tubes when said rotor is in its other extreme position along said shaft.

* * * * *